US007918129B2

(12) United States Patent
Coppola et al.

(10) Patent No.: US 7,918,129 B2
(45) Date of Patent: Apr. 5, 2011

(54) DIAGNOSTIC SYSTEMS FOR COOLING SYSTEMS FOR INTERNAL COMBUSTION ENGINES

(75) Inventors: John Coppola, Highland, MI (US); Jose L. Deleon, Madison Heights, MI (US); James M. Dixon, Commerce Township, MI (US)

(73) Assignee: GM Global Technology Operations LLC

( * ) Notice: Subject to any disclaimer, the term of this patent is extended or adjusted under 35 U.S.C. 154(b) by 61 days.

(21) Appl. No.: 12/245,300

(22) Filed: Oct. 3, 2008

(65) Prior Publication Data

US 2009/0293600 A1 Dec. 3, 2009

Related U.S. Application Data

(60) Provisional application No. 61/056,155, filed on May 27, 2008.

(51) Int. Cl.
*G01M 15/04* (2006.01)

(52) U.S. Cl. ..... 73/114.68

(58) Field of Classification Search ..... 73/114.68
See application file for complete search history.

(56) References Cited

U.S. PATENT DOCUMENTS

| | | | | |
|---|---|---|---|---|
| 4,580,531 | A * | 4/1986 | N'Guyen | 123/41.1 |
| 6,085,732 | A * | 7/2000 | Wang et al. | 123/568.12 |
| 6,302,065 | B1 * | 10/2001 | Davison | 123/41.15 |
| 6,363,922 | B1 * | 4/2002 | Romzek et al. | 123/568.16 |
| 6,694,246 | B2 | 2/2004 | Masuda et al. | |
| 6,826,903 | B2 * | 12/2004 | Yahata et al. | 60/278 |
| 7,168,399 | B2 * | 1/2007 | Wakahara | 123/41.15 |
| 7,267,086 | B2 * | 9/2007 | Allen et al. | 123/41.44 |
| 7,325,447 | B2 * | 2/2008 | Miyahara et al. | 73/114.68 |
| 7,409,928 | B2 * | 8/2008 | Rizoulis et al. | 123/41.01 |
| 7,631,552 | B2 * | 12/2009 | Keski-Hynnila et al. | 73/114.74 |
| 2002/0111734 | A1 | 8/2002 | Wakahara et al. | |
| 2006/0042608 | A1 * | 3/2006 | Buck et al. | 123/568.12 |
| 2007/0034172 | A1 * | 2/2007 | Miyahara et al. | 123/41.1 |
| 2007/0175414 | A1 * | 8/2007 | Miyahara et al. | 123/41.1 |
| 2007/0175415 | A1 * | 8/2007 | Rizoulis et al. | 123/41.05 |
| 2008/0300774 | A1 * | 12/2008 | Wakahara | 701/113 |
| 2009/0118090 | A1 * | 5/2009 | Heap et al. | 477/98 |
| 2009/0293600 | A1 * | 12/2009 | Coppola et al. | 73/114.68 |
| 2010/0051001 | A1 * | 3/2010 | Webb et al. | 123/568.12 |
| 2010/0058848 | A1 * | 3/2010 | Hamama et al. | 73/114.68 |
| 2010/0063710 | A1 * | 3/2010 | Asai et al. | 701/103 |

* cited by examiner

*Primary Examiner* — Freddie Kirkland, III

(57) ABSTRACT

A control system for an engine system includes a temperature sensor and a diagnostic module. The temperature sensor measures an outlet temperature at an outlet of a cooling system. The diagnostic module estimates the cooling fluid temperature, determines the cooling performance based on the outlet temperature and the cooling fluid temperature, and selectively diagnoses a fault in the cooling system based on the cooling performance and a predetermined threshold.

9 Claims, 3 Drawing Sheets

DIAGNOSTIC SYSTEMS FOR COOLING SYSTEMS FOR INTERNAL COMBUSTION ENGINES

CROSS-REFERENCE TO RELATED APPLICATIONS

This application claims the benefit of U.S. Provisional Application No. 61/056,155, filed on May 27, 2008. The disclosure of the above application is incorporated herein by reference.

FIELD

The present disclosure relates to internal combustion engines, and more particularly to diagnostic systems for cooling systems for internal combustion engines.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines ignite a fuel and air mixture to produce drive torque. More specifically, air is drawn into the engine through a throttle and mixed with fuel to form an air and fuel mixture. The air and fuel mixture is compressed within a cylinder by a piston and is then ignited within a cylinder to reciprocally drive the piston within the cylinder. The piston rotatably drives a crankshaft of the engine.

Exhaust gas recirculation (EGR) systems are used to reduce engine exhaust emissions by directing a portion of the exhaust gas back to the intake manifold. The re-circulated exhaust gas is mixed with fuel and air and combusted in the engine. Prior to entering an intake manifold, the re-circulated exhaust gas is cooled to keep the intake manifold below a predetermined temperature. A cooling system, including, but not limited to, an EGR cooler, is generally provided for this purpose.

A turbocharger may include a turbine and a compressor linked by a shared axle. The exhaust gas may enter the turbine inlet, causing a turbine wheel to rotate. This rotation drives the compressor to compress ambient air and deliver the compressed air into the air intake manifold of the engine. The compressed air results in a greater amount of air entering the cylinder. A cooling system, including, but not limited to, a charge air cooler, may cool the compressed air before it enters the engine.

Performance of the cooling system (for example only, the EGR cooler or the charge air cooler) is generally monitored by two temperature sensors. One temperature sensor is provided at an inlet of the cooling system and the other temperature sensor is provided at an outlet of the cooling system. The efficiency of the cooling system is determined by comparing the inlet temperature with the outlet temperature of the fluid flowing through the cooling system.

SUMMARY

Accordingly, a control system for an engine system includes a temperature sensor and a diagnostic module. The temperature sensor measures an outlet temperature at an outlet of a cooling system. The diagnostic module estimates a cooling fluid temperature, determines a cooling performance based on the outlet temperature and the cooling fluid temperature, and selectively diagnoses a fault in the cooling system based on the cooling performance and a predetermined threshold.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
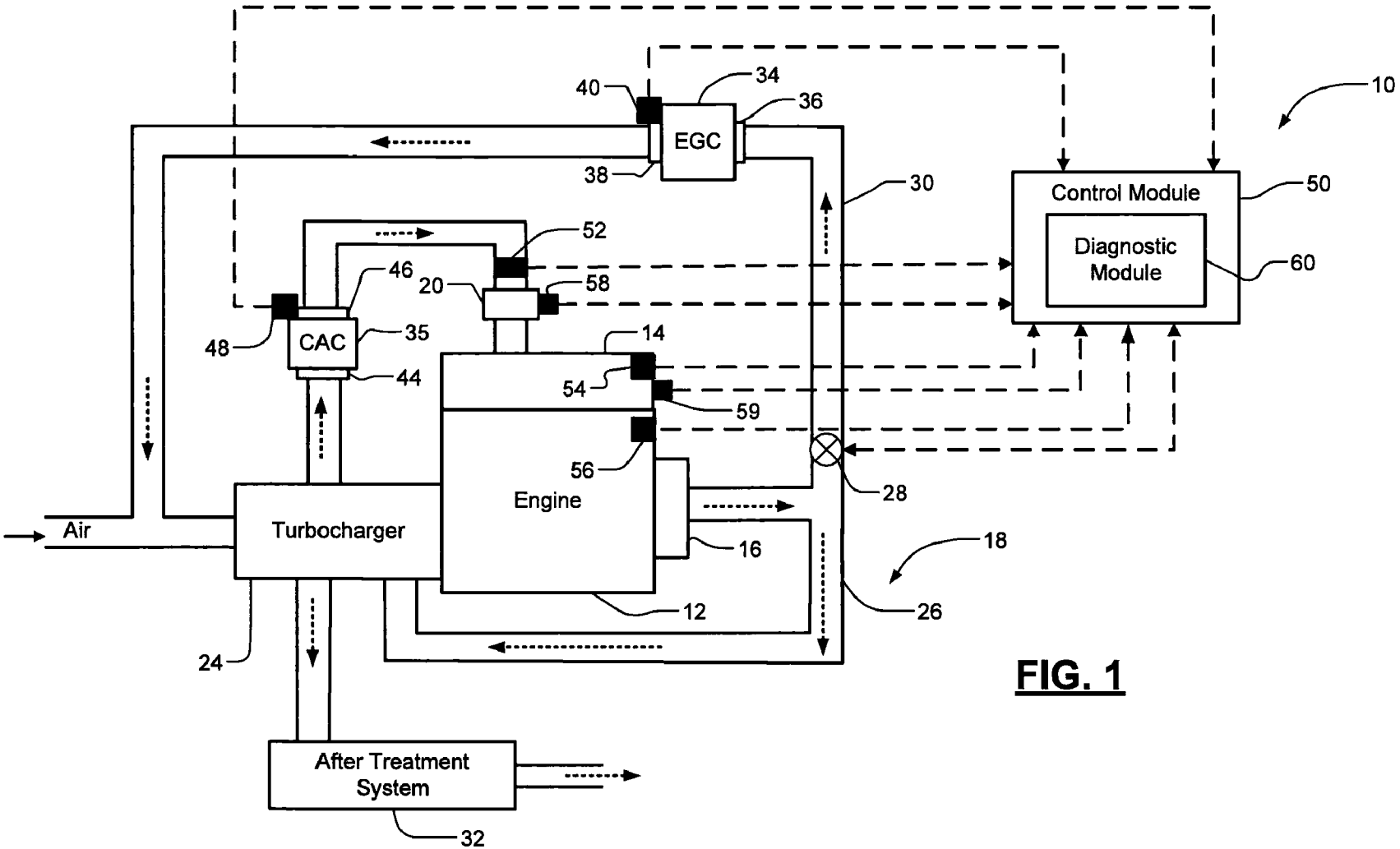
FIG. 1 is a functional block diagram of an internal combustion engine system including a cooling system that is regulated in accordance with a diagnostic system of the present disclosure.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

A diagnostic system for a cooling system in accordance with the teachings of the present disclosure may eliminate a temperature sensor at the cooling system, (for example only, at the inlet). An inlet temperature of the cooling system is not needed because the performance of the cooling system is based on the temperature of the cooling fluid. The cooling fluid temperature is estimated based on a temperature measured by an existing temperature sensor, including but not limited to, an intake air temperature sensor or an engine coolant temperature sensor.

Referring now to FIG. 1, an exemplary engine system 10 is schematically illustrated. The engine system 10 includes an engine 12, an intake manifold 14, an exhaust manifold 16, and an exhaust system 18. Air is drawn into a compressor of a turbocharger 24, then through a CAC 35, then through a throttle 20 into the intake manifold 14, which distributes air to the cylinders (not shown). Fuel is injected into cylinders by the common rail injection system (not shown) and the heat of the compressed air ignites the air/fuel mixture. The combustion of the air/fuel mixture generates a combustion force to drive pistons (not shown) that rotatably drive a crankshaft (not shown). The exhaust gas exits from the cylinders, through the exhaust manifold 16, and into the exhaust system 18. The turbocharger 24 pumps additional air into the cylinders for combustion with the fuel and air drawn in from the intake manifold 14.

The exhaust system 18 includes an exhaust conduit 26, an exhaust gas recirculation (EGR) valve 28, an EGR conduit 30, and an after treatment system 32. The after treatment system 32 reduces emissions in the exhaust gas before the exhaust gas is released to the atmosphere. The exhaust manifold 16 directs the exhaust gas from the cylinders into the exhaust manifold 16. A portion of the exhaust gas is directed to the EGR conduit 30 and the remaining portion of the exhaust gas is directed into the exhaust conduit 26 to drive the turbocharger 24.

The EGR valve 28 controls the flow rate of the exhaust gas re-circulated to the intake manifold 14. The re-circulated exhaust gas is mixed with air from the intake throttle 20. The mixture of the intake air and the re-circulated exhaust gas is sent to the engine 12.

The engine system 10 may include a cooling system that includes an exhaust gas recirculation cooler (EGC) 34 and/or a charge air cooler 35. The EGC 34 that cools the re-circulated exhaust is provided in the EGR conduit 30 and has an inlet 36 and an outlet 38. An EGC temperature sensor 40 is provided at the outlet 38 for measuring an outlet temperature of the cooled exhaust gas.

The charge air cooler (CAC) 35 may be provided adjacent to the intake manifold 14 for cooling compressed air from the turbocharger's compressor. The CAC 35 has an inlet 44 and an outlet 46. A CAC temperature sensor 48 is provided at the outlet 46 for measuring an outlet temperature of the air cooled by the CAC 35.

A control module 50 controls engine components including, but not limited to, fuel injection, ignition timing, variable valve timing and peripherals relating to the engine operation. The control module 50 communicates with a plurality of sensors for monitoring the engine operations and controls the engine operations accordingly. The sensors include, but are not limited to, an intake air temperature (IAT) sensor 52, an intake manifold absolute pressure (MAP) sensor 54, an engine speed sensor 56, a mass air flow (MAF) sensor 58, an engine coolant temperature sensor 59, the EGC temperature sensor 40, and the CAC temperature sensor 48.

The intake air temperature sensor 52 generates a signal indicating the IAT of the air. The EGC temperature sensor 40 generates a signal indicating an outlet temperature of the fluid (i.e., the re-circulated exhaust gas) that is cooled by the EGC 34. The CAC temperature sensor 48 generates a signal indicating a signal representing an outlet temperature of the fluid (i.e., air) that is cooled by the CAC 35. The engine speed sensor 56 generates a signal indicating engine speed (RPM). The MAF sensor 58 generates a signal indicating the MAF into the intake manifold 14. The engine coolant temperature sensor 59 measures a coolant temperature of an engine cooling apparatus (not shown) that cools the engine 12.

The control module 50 includes a diagnostic module 60 in communication with the CAC temperature sensor 48, the EGC temperature sensor 40, the intake air temperature sensor 52, and the engine coolant temperature sensor 59. The diagnostic module 60 diagnoses the cooling performance of the CAC 35 and EGC 34.

Figure 2:
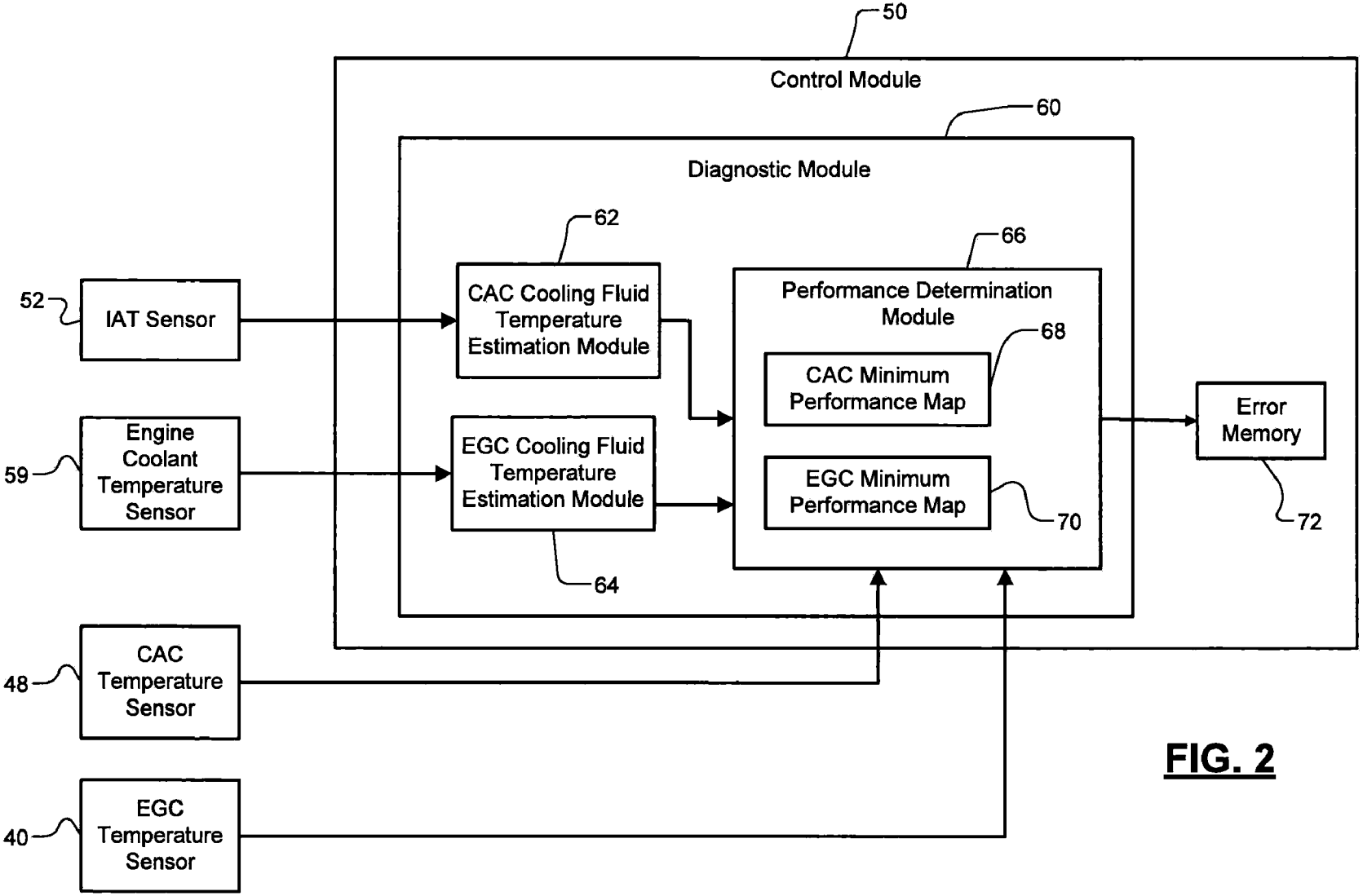
FIG. 2 is a control block diagram of a control module incorporating a diagnostic module of the present disclosure.

Referring to FIG. 2, the control module 50 includes the diagnostic module 60. The diagnostic module 60 includes a CAC cooling fluid temperature estimation module 62, an EGC cooling fluid temperature estimation module 64, and a performance determination module 66. The CAC cooling fluid temperature estimation module 62 communicates with the IAT sensor 52 and estimates a cooling fluid temperature of the CAC 35 based on the IAT. Therefore, the estimated cooling fluid temperature ($T_{CAC\ input}$) of the CAC 35 is equal to the intake air temperature (IAT). The EGC cooling fluid temperature estimation module 64 communicates with the engine coolant temperature sensor 59 and estimates the EGC cooling fluid temperature based on a coolant temperature ($T_{CTS}$) of the coolant of a cooling apparatus that cools the engine 12. The same coolant for the engine cooling apparatus is also used in the EGC 34.

In view of the distance between the EGC 34 and the engine cooling apparatus and the distance between the CAC and the air inlet, a temperature difference can occur between these two measure points. Therefore, in general, the estimated cooling fluid temperature ($T_{EGC\ input}$ or $T_{CAC\ input}$) is equal to the coolant temperature ($T_{CTS}$ or $T_{IAT}$) plus an offset. While the cooling fluid temperatures ($T_{EGC\ input}$ and $T_{CAC\ input}$) of the EGC 34 and the CAC 35 are estimated, the cooling fluid temperatures are based on actually measured temperatures. Therefore, complicated models for estimating the cooling fluid temperatures are not necessary.

The performance determination module 66 communicates with the CAC temperature sensor 48, EGC temperature sensor 40, the CAC cooling fluid temperature estimation module 62, and the EGC cooling fluid temperature estimation module 64. The performance determination module 66 includes a performance determining algorithm for the CAC 35 and EGC 34.

The performance determination module 66 obtains a calculated cooling performance of the CAC 35 based on the estimated CAC cooling fluid temperature and the measured CAC temperature from the CAC temperature sensor 48. The performance determination module 66 can also obtain a calculated cooling performance of the EGC 34 based on the estimated EGC cooling fluid temperature from the EGC cooling fluid temperature estimation module 64 and the measured EGC outlet temperature from the EGC temperature sensor 40.

In general, the cooling performance of a cooling system is defined as $$n=1-[\text{Cooled Fluid temp}-\text{Estimated Cooling Fluid temp}]/\text{Estimated Cooling Fluid temp}$$

wherein N is the calculated cooling performance; the cooled fluid temperature is a measured temperature at an outlet of a cooling system; the estimated fluid temperature is an estimated temperature of the cooling fluid temperature for a cooling system, which may be an EGC or a CAC.

Accordingly, a calculated performance of the CAC is defined as $$N=1-[T_{CACout}-T_{CAC\ input}]/T_{CAC\ input}$$

$$N=1-[T_{CACout}-(\text{IAT}+\text{offset})]/(\text{IAT}+\text{offset})$$

wherein N is the cooling performance of CAC; $T_{CAC\ out}$ is a measured outlet temperature of the cooled fluid in the CAC measured by the CAC temperature sensor; $T_{CAC\ input}$ is an estimated cooling fluid temperature of the fluid used to cool the CAC; IAT is a measured intake air temperature from the IAT sensor; and offset is a correction factor, taking into account a temperature difference between air temperature at the IAT sensor and the temperature of the cooling fluid at the inlet of the CAC.

Similarly, a calculated performance for the EGC is defined as $$N=1-[T_{EGC\ out}-T_{EGC\ input}]/T_{EGC\ input}$$

$$N=1-[T_{EGC\ out}-(T_{CTS}+\text{offset})]/(T_{CTS}+\text{offset})$$

wherein N is the cooling performance of EGC; $T_{EGC\ out}$ is a measured outlet temperature of the cooled fluid that flows through the EGC; $T_{EGC\ input}$ is an estimated cooling fluid temperature of the fluid used to cool the EGC; $T_{CTS}$ is a measured coolant temperature from the engine coolant temperature sensor at an engine cooling apparatus; and offset is a correction factor, taking into account a temperature difference between coolant at the engine coolant temperature sensor and the coolant at the inlet of the EGC.

The offset is applied to the cooling fluid estimation when the measuring point of the cooling fluid is far from the cooler.

The calculated cooling performance can be filtered with a low-pass filter (e.g., a PT1 filter) to achieve a steady output suitable for diagnostic purposes. The low-pass filter passes low-frequency signals but attenuates signals with frequencies higher than a cutoff frequency. The performance determination module 66 includes a CAC minimum performance map 68 and an EGC minimum performance map 70. The calculated cooling performance is compared with the values on the CAC minimum performance map 68 or the EGC minimum performance map 70. The CAC minimum performance map 68 is made based on vehicle operating parameters, including but not limited to, vehicle speeds and mass air flow rates. The EGC performance map 70 is made based on engine operating parameters, including but not limited to, engine speeds and mass air flow rates. If the calculated cooling performance is below a predetermined threshold on the minimum performance map 68 or 70 for an extended period of time, the performance determination module 66 generates a signal to a memory 72 indicating a fault in the EGC 34 or the CAC 35.

Figure 3:
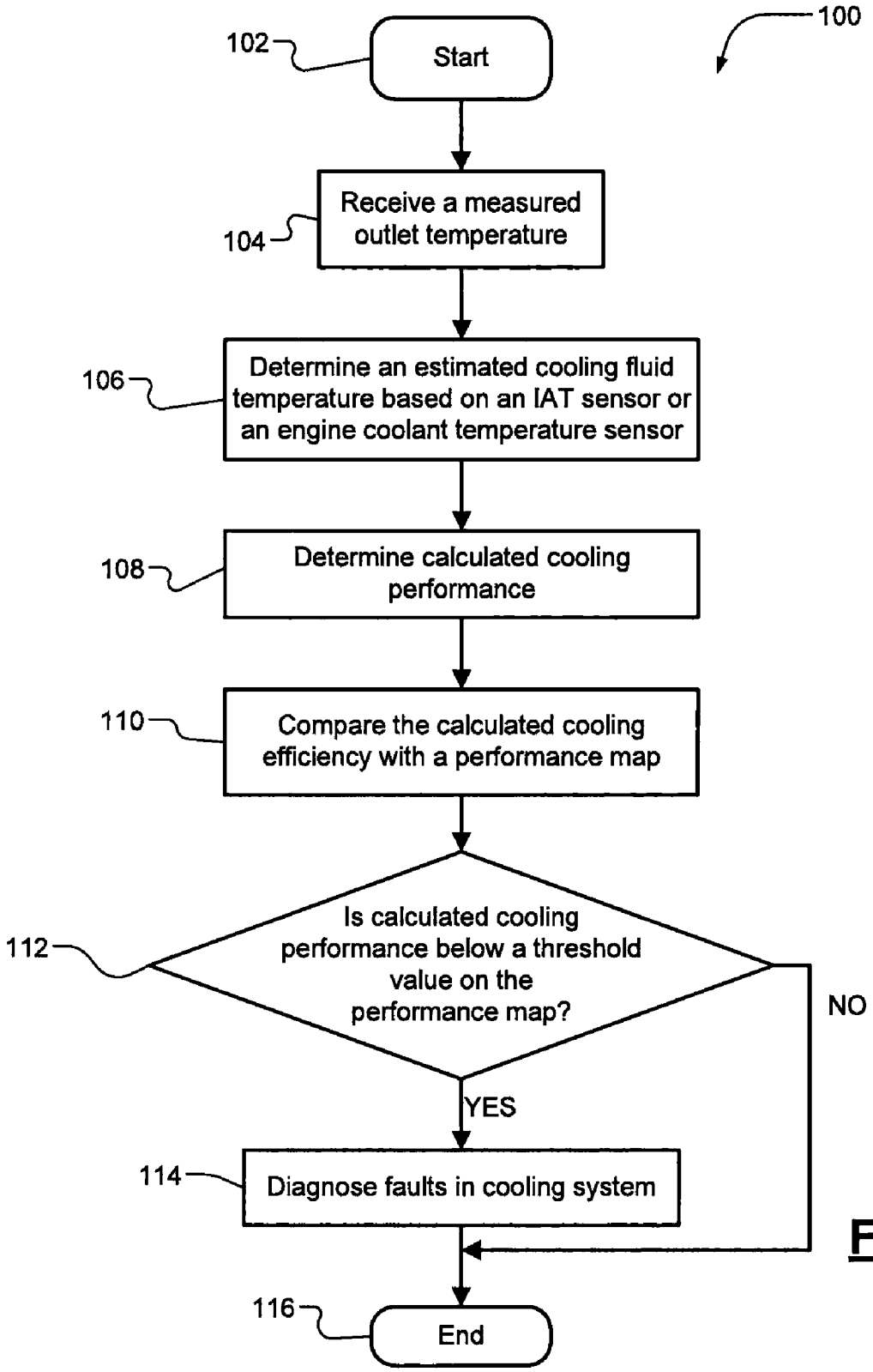
FIG. 3 is a flowchart illustrating exemplary steps that are executed by a diagnostic module of the present disclosure.

Referring to FIG. 3, a method 100 of diagnosing the cooling performance of a cooling system starts at step 102. The diagnostic module 60 receives a measured outlet temperature from an EGC temperature sensor 40 or a CAC temperature sensor 48 at the outlet of the EGC 34 or the CAC 35 in step 104. The diagnostic module 60 also receives a temperature from an existing temperature sensor and uses the measured temperature to estimate the cooling fluid temperature of the cooling system in step 106. If the cooling system is a CAC 35, the estimated cooling fluid temperature is a measured IAT from the IAT sensor 52 with an offset (typically zero). If the cooling system is an EGC 34, the estimated cooling fluid temperature is a measured coolant temperature from the engine coolant temperature sensor 59 with an offset. The offset depends on a temperature difference between the coolant temperature at the engine cooling apparatus and the coolant temperature at the inlet 36 of the EGC 34. In step 108, the diagnostic module 60 calculates a cooling performance based on the measured outlet temperature and the estimated cooling fluid temperature. In step 110, the performance determination module 66 compares the calculated cooling performance with a minimum performance map. If the calculated cooling performance is below a predetermined threshold on the minimum performance map in step 112, the performance determination module 66 diagnoses a fault in the performance of the cooling system in step 114. The entire process ends at step 116.

With the diagnostic system of the present disclosure, only one temperature sensor provided at the outlet of the EGC 34 or the CAC 35 is used for the performance diagnosis. The cooling fluid temperature is estimated based on a measured temperature from existing temperature sensors, including but not limited to, the IAT temperature sensor 52 and the engine coolant temperature sensor 59. Therefore, complicated calibration is not necessary.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A control system for an engine system comprising:

a temperature sensor that measures an outlet temperature of a gas at an outlet of a cooling system; and a diagnostic module that estimates a cooling fluid temperature, that determines a cooling performance based on a difference between the outlet temperature and the cooling fluid temperature, and that selectively diagnoses a fault in the cooling system based on the cooling performance and a predetermined threshold.

2. The control system of claim 1 wherein the diagnostic module estimates the cooling fluid temperature based on an intake air temperature.

3. The control system of claim 2 wherein the cooling system includes a charge air cooler (CAC).

4. The control system of claim 2 wherein the predetermined threshold is determined based on a vehicle speed and a mass air flow rate.

5. The control system of claim 1 wherein the diagnostic module estimates the cooling fluid temperature based on an engine coolant temperature of an engine cooling apparatus.

6. The control system of claim 5 wherein the cooling system is includes an exhaust gas recirculation cooler (EGC).

7. The control system of claim 5 wherein the predetermined threshold is based on an engine speed and a mass air flow rate.

8. The control system of claim 1 wherein the diagnostic module determines a fault in the cooling system when the cooling performance is below the predetermined threshold.

9. The control system of claim 1 wherein the diagnostic module does not communicate with a temperature sensor at an inlet of the cooling system.

* * * * *